United States Patent [19]

Gander

[11] 4,351,139

[45] Sep. 28, 1982

[54] CONNECTING ELEMENT FOR CONCRETE OR REINFORCED CONCRETE STRUCTURAL MEMBERS THAT ARE TO BE CAST ONE AFTER THE OTHER

[75] Inventor: Peter Gander, Thun-Gwatt, Switzerland

[73] Assignee: Armex AG, Thun-Lerchenfeld, Switzerland

[21] Appl. No.: 224,285

[22] PCT Filed: Jun. 28, 1979

[86] PCT No.: PCT/CH79/00095

§ 371 Date: Jul. 14, 1980

§ 102(e) Date: Jul. 14, 1980

[87] PCT Pub. No.: WO80/01088

PCT Pub. Date: May 29, 1980

[30] Foreign Application Priority Data

Nov. 20, 1978 [CH] Switzerland ..... 11853/78
Jun. 8, 1979 [CH] Switzerland ..... 5348/79

[51] Int. Cl.[3] ..... E04B 1/41
[52] U.S. Cl. ..... 52/378; 52/709
[58] Field of Search ..... 52/378, 379, 709, 713, 52/701

[56] References Cited

U.S. PATENT DOCUMENTS 1,359,290 11/1920 Towe ..... 52/709 X
1,608,492 11/1926 Cox ..... 52/708
1,705,739 3/1929 Selah ..... 52/709 X
1,777,926 10/1930 Lilland ..... 52/378 X
3,890,758 6/1975 Bouchard ..... 52/713
3,958,382 5/1976 Walt ..... 52/709 X
4,007,563 2/1977 Nakagawa ..... 52/378 X
4,024,688 5/1977 Calini ..... 52/378

FOREIGN PATENT DOCUMENTS 1659007 10/1970 Fed. Rep. of Germany ..... 52/709

*Primary Examiner*—J. Karl Bell
*Attorney, Agent, or Firm*—Brady, O'Boyle & Gates

[57] ABSTRACT

A connecting element for concrete or reinforced concrete structural members that are to be cast one after the other has a body (1) having at least one continuous threaded hole (nut 5). The body (1) is designed for releasable fastening to the shuttering for the structural member that is to be cast first of all. In this respect, the half, averted from the shuttering, of the threaded hole serves to receive an end, provided with an external thread, of a reinforcing part (9) that is to be embedded into the structural member that is to be cast first of all, and the other half of the threaded hole serves, after removal of the shuttering, to receive an end, provided with an external thread, of a reinforcing part (11) that is to be embedded into the structural member that is to be cast after that.

20 Claims, 10 Drawing Figures

CONNECTING ELEMENT FOR CONCRETE OR REINFORCED CONCRETE STRUCTURAL MEMBERS THAT ARE TO BE CAST ONE AFTER THE OTHER

In the past, of two (non-reinforced) concrete structural members that were to be cast one after the other, the second one has simply been cast contiguous to the first one, whereby a connection was achieved which was not very strong. In order to obtain greater strength, at the location of the first concrete structural member to which the second one was supposed to link up, depressions have been formed upon the casting or been produced subsequently. When the second concrete structural member was being cast, the concrete thereof also filled up the depressions. In this way, projections engaging into the depressions were formed on the second concrete structural member.

The strength of the connection depended on the number, shape and size of the projections, but was less than the strength of the concrete structural members themselves. In the case of reinforced concrete structural members, reinforcing bars of the reinforced concrete structural member that was to be cast first were caused to project, at the intended connection point, through holes bored into the shuttering, in order then to embed them into the reinforced concrete structural member that was to be cast subsequently. In this way, a very strong connection was achieved. However, the reinforcing bars partially jutting out already upon the placing of the reinforcement for the first reinforced concrete structural member and then upon the casting, setting and removal of the shuttering from the same were troublesome and the cause of accidents. To avoid these disadvantages it is known (Swiss Pat. No. 562,376) to embed reinforcing bars, bent in U-shaped manner and having bent limbs, in such a way into a foam material body that the U-stirrups jut out at one side of the body, to fasten the body by its opposite side to the inner surface of the shuttering for the structural member to be cast first of all, to scrape the foam material out after the concrete has set, and then to bend the limb ends in such a way that they project from the first structural member, in order to embed them into the second structural member. The production of the foam material body with the embedded bent limb ends, the scraping out of the foam material and the bending back of the bent limb ends is, however, complicated.

The problem underlying the invention is to connect concrete or reinforced concrete structural members that are to be cast one after the other (for example two walls, two ceilings or one wall and one ceiling) securely to one another in a simple manner requiring little working time as a result of economical connecting elements which are not bulky upon their storage and upon transportation, and to avoid as long as possible reinforcing parts which protrude from the first structural member.

In accordance with the invention, this problem is solved by the connecting element in accordance with Patent claim 1.

The connecting elements in accordance with Patent claims 2 to 15 are further developments of the invention. More especially with the connecting element in accordance with Patent claim 5 the result is achieved that the latterly cast structural member is given, at the connection point, projections which engage into depressions which have come about in the case of the previously cast structural member, whereby the shear strength of the connection is increased. In the case of the further development in accordance with Patent claims 5 and 6, additionally also the tensile strength of the connection is increased.

Exemplified embodiments of the connecting element in accordance with the invention, and the uses thereof, are shown in the drawings, in which:

FIGS. 5 and 6 show two sectional views, at right angles to one another, of a concrete or reinforced concrete structural member with three connecting elements in accordance with FIG. 1 for connection to a concrete or reinforced concrete structural member that is to be cast on;

FIG. 9 shows a schematic sectional view of a concrete or reinforced concrete structural member, with the connecting element shown partially in FIGS. 7 and 8, for connection to a concrete or reinforced concrete structural member that is to be cast on.

Figure 1:
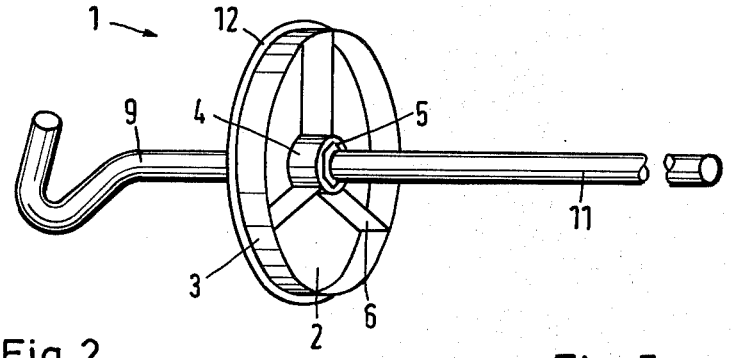
FIG. 1 shows a perspective view of a connecting element.
Figure 2:
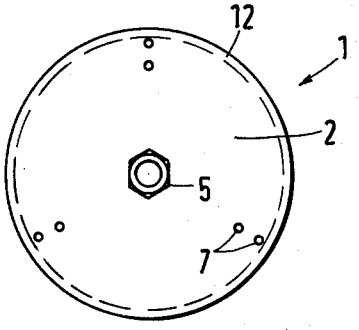
FIG. 2 shows a rear view of a component part of the connecting element, in the direction looking from the left in FIG. 1.
Figure 5:
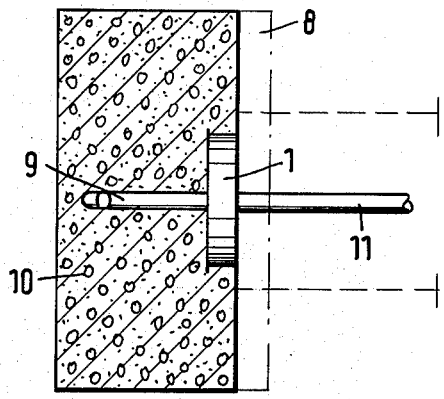
Figure 3:
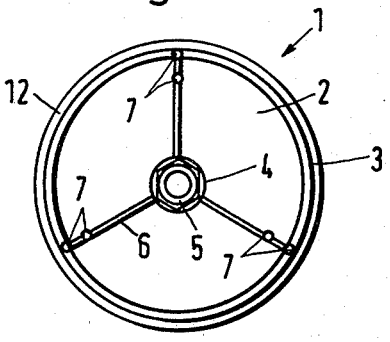
FIG. 3 shows a front view of the component part, in the direction looking from the right in FIG. 1.
Figure 6:
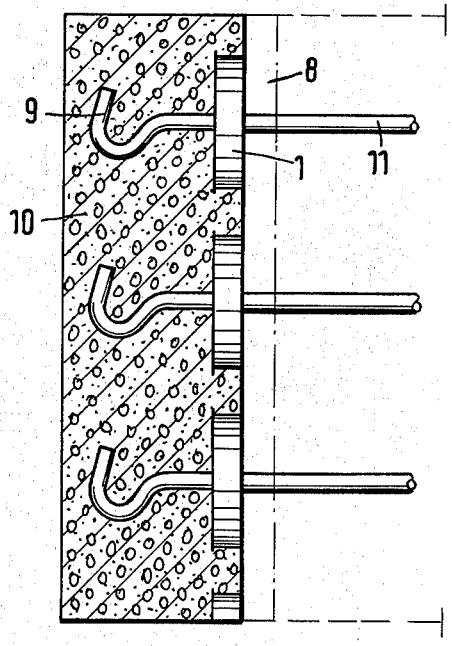
Figure 4:
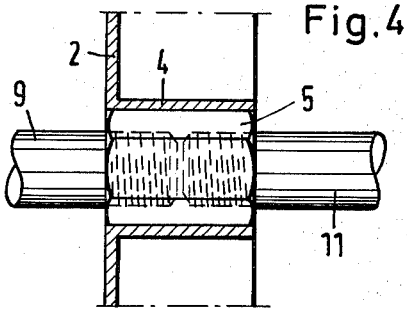
FIG. 4 shows a diametral section through a detail from FIG. 1.

The connecting element shown in FIGS. 1 to 6 consists of a substantially dish-shaped body 1 produced in one piece from plastics material, and two reinforcing parts 9 and 11 which are provided, at one end, with an external thread. The parts 9 and 11 are designated as reinforcing parts, because it is a matter of steel parts, to be embedded in concrete, along the lines of reinforcing bars (for example with rolled-on transverse ribs). Upon the connection of (non-reinforced) concrete structural members it is not a matter of a reinforcing action of the reinforcing parts 9 and 11 but (as also in the case of reinforced concrete) of their secure embedding into the concrete. The body 1 has a flat dish base 2, a hollow-cylindrical dish edge 3, a central projection 4 with a coaxial through-hole into which a nut 5 is pressed or embedded, and radial ribs 6 which connect the projection 4 to the edge 3 and are connected to the base 2. The body 1 has, near its peripheral edge, holes 7, parallel to its geometrical axis and passing respectively through the base 2 and a rib 6, for releasable fastening means, more especially nails. The base 2 projects beyond the dish edge 3 and forms there a flange 12 which is radial to the geometrical axis of the nut 5. The end surface, perpendicular to this axis, of the dish edge 3 and the end surface of the projection 4 lie in one plane.

Two concrete or reinforced concrete structural members that are to be cast one after the other are connected together by, as a rule, several such connecting elements, by the connecting elements being connected, upon the casting of the one structural member, to this and after that, upon the casting of the other structural member, to the other one. For this purpose, the dish-shaped bodies 1 of the connecting elements are nailed at the connecting point, by means of nails passed through the holes 7, onto the inside (the left side in FIGS. 5 and 6) of the shuttering 8 (shown in dot-dash lines) for the structural member 10 that is to be cast first, namely in such a way that the open side of each dish-shaped body 1 is turned to the shuttering 8 and the end surface of its edge 3 butts tightly against the shuttering 8. In this respect, also the projection 4 borders tightly against the shuttering 8, because it lies in the same plane as the edge end surface. Then (or even previously) the end, provided with an external thread, of a reinforcing part 9, in the example a reinforcing bar which is curved in hook-shaped manner at the other end, is screwed into the half (the left-hand half in FIGS. 5 and 6), averted from the shuttering 8, of the nut 5 of each body 1. After the casting of the structural member 10, the reinforcing parts 9 and the bodies 1 are embedded into the concrete, in which respect the hook-shaped ends of the reinforcing bars 9 and the flanges 12 of the bodies 1 are connected positively to the structural member 10. After the shuttering of the structural member 10 has been removed, the nail ends protruding on the body 1 are nipped off or bent over. Prior to the casting of the other structural member which is intended to be contiguous to the structural member 10 and is intended to be connected to this upon the casting (that one is not shown in FIGS. 5 and 6 and is cast on at the side, to the right in these Figures, of the structural member 10), the end, provided with an external thread, of one of the other reinforcing part (sic) 11, shown broken off in the drawing, is screwed into the other half (the right-hand one in FIGS. 5 and 6) of each nut 5. The state shown in FIGS. 5 and 6 (without the shuttering 8 shown in dot-dash lines) then arises. Of respectively two reinforcing parts 9 and 11 which are connected securely to one another by a nut 5, one, namely the reinforcing part 9, is embedded into the already cast structural member 10. The other one, namely the reinforcing part 11, protrudes at the location that is to be connected, in order to be embedded, upon the casting of the contiguous structural member, into this latter. The structural member 10 has, at the side at which the other structural member is to be cast on (to the right in FIGS. 5 and 6), a number of depressions each formed by one of the hollow bodies 1. Upon the casting of the other contiguous structural member, these depressions (the hollow spaces of the bodies 1) fill with concrete, so that this structural member is given projections which correspond to the depressions and which engage into these latter. In this way, the two structural members are connected positively in shear-strong manner in addition to the connection by the reinforcing parts 9 and 11 which are screwed together by means of the nuts 5. The dish-shaped bodies 1 can remain in the connection. It is not necessary to remove them prior to the casting of the adjoining structural member. The reinforcing parts 9 and 11, of which also the latter could be curved in hook-shaped manner, ensure the tensile strength of the connection.

The hollow space of the body 1 serves not only for forming the depressions in the firstly-cast structural member 10 and the projections of the subsequently-cast structural member which engage into these depressions; it also forms a collecting chamber for concrete which upon the casting of the first structural member 10 possibly penetrates at untight locations between the edge 3 of the body 1 and the shuttering 8. This concrete, which could pass without the hollow space between the nut and the shuttering and there pollute the nut thread, collects in the hollow space.

By the bodies 1 not being nailed directly to the inside of the shuttering but to a board which is situated on the inside of the shuttering and which is removed when the shuttering is removed, the result can be achieved that the second structural member penetrates still more deeply into the first one.

The dish edge 3 of the bodies 1 can, instead of in cylinder-jacket-shaped manner, also extend tapered in cone-jacket-shaped manner towards the open side of the body. In this way the hollow spaces in the firstly-cast structural member 10 are given an inwardly-widened cross-section and the projections of the other structural member are given a dovetailed cross-section which is adapted to this cross-section. In this respect, the two structural members are then also connected together directly in tensile-strong manner, in addition to the indirect connection by the reinforcing parts. The flange 12 can be omitted in the case of this embodiment.

The threads at the ends of the reinforcing parts 9 and 11 are advantageously each less than half as long as the nut 5. The body 1 may have a surface affording a firm grip at its inside and outside.

Figure 7:
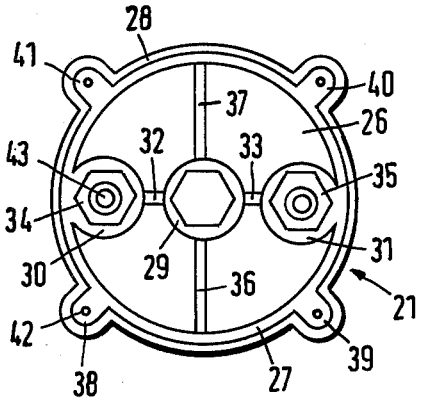
FIG. 7 shows a front view, corresponding to FIG. 3, of a component part of a modification of the connecting element.
Figure 8:
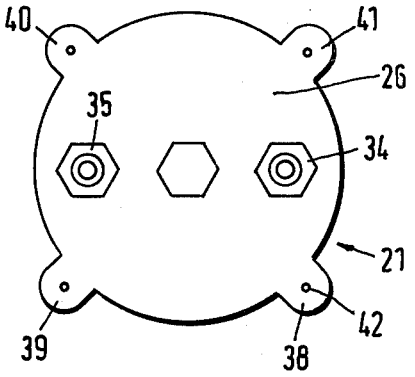
FIG. 8 shows a rear view, corresponding to FIG. 2, of the component part shown in FIG. 7.
Figure 9:
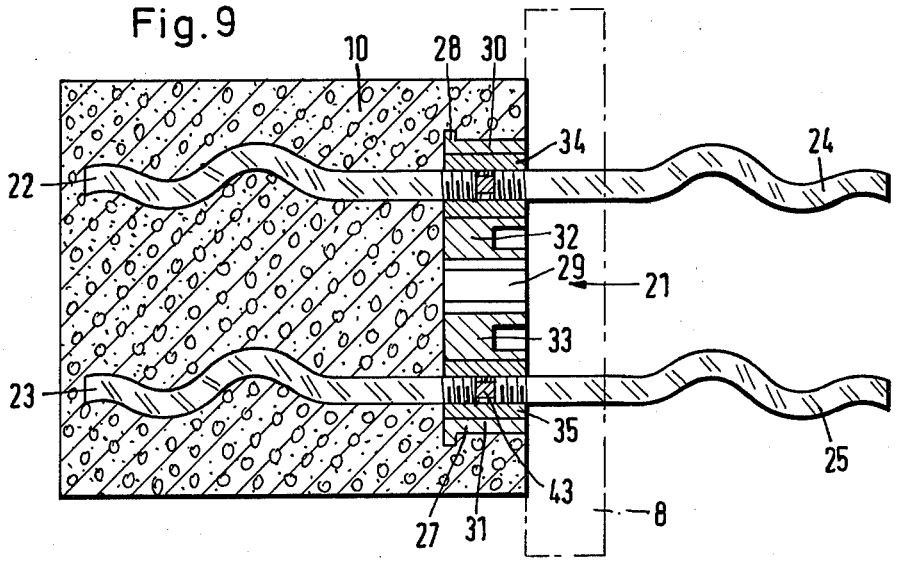

The modification shown in FIGS. 7 to 9 consists of a one-piece plastics body 21 and four reinforcing parts 22 to 25 which are each provided at one end with external threads. The body 21 has, like the body 1, a flat dish base 26 and a hollow-cylindrical dish edge 27, beyond which the base 26 projects to form a radial flange 28. In addition to a central cylindrical projection 29 which corresponds to the projection 4 of the body 1, the body 21 has additionally two further projections 30 and 31 which are formed at mutually diametrically opposed locations of the dish edge 27 and are connected by radial ribs 32, 33 to the central projection 29. The projections 29 to 31 are hollow, open at both end faces and their inner walls are hexagonal in design, so that hexagonal nuts can be pressed in. In the exemplified embodiment shown, two nuts 34, 35 are pressed into the two outer projections 30 and 31; the central projection 29 is not used in the case of this example.

Two further radial ribs 36, 37 support the central projection 29 at the dish edge 27 and four ribs 38 to 41 are formed at equal distances from one another on the outside of the dish edge 27 and are provided with through-holes 42 for nails. The ribs 32, 33, 36 and 37 are connected to the base 26, and the ribs 38 to 41 are connected to the flange 28 which is widened in their region. The end surfaces, visible in FIG. 7, of the projections 29 to 31 and of the ribs 38 to 41 lie together with the end surface of the dish edge 27 in a plane which extends perpendicular to the axes of the nuts 34, 35 or of the projections 29 to 31 respectively. The end surfaces, visible in FIG. 7, of the ribs 32, 33, 36 and 37 extend at a spacing from this plane, namely inside the dish edge 27.

In the end, visible in FIG. 7, of the threaded hole of each of the two nuts 34 and 35 there is fixed a respective plug 43 made of foam material, for example polystyrene or foam rubber, which prevents any pollution of the thread end lying upon the casting of the one structural member 10 against the shuttering 8. (Prior to the casting the reinforcing part 22 or 23 respectively is screwed into the other thread end).

The reinforcing parts 22 to 25 are, in contrast to the reinforcing parts 9 and 11, all the same, namely designed so as to be straight at the end which is provided with the thread, and then designed so as to be curved in wavelike manner, which ensures a tensile-strong connection of the concrete structural members.

As shown in FIG. 9, the modified embodiment is used in the same way as the connecting element in accordance with FIG. 1 for the connection of two concrete structural members: The plastics body 21 is nailed, with four nails which are passed through the holes 42 of the ribs 38 to 41, against the shuttering 8 (indicated in dot-dash lines), whereupon the two reinforcing parts 22 and 23 are mounted. During the subsequent casting of the concrete structural member 10, the plugs 43 prevent concrete, which may possibly pass through nontight points between the edge 27 and the shuttering 8 into the body 21, from penetrating into the threaded holes of the nuts 34, 35. After the shuttering has been removed, the reinforcing parts 24, 25 are immediately screwed into the threaded holes which are sealed with the plastics plugs 43, in which respect those are compressed between the end surfaces of the threaded bolts of the reinforcing bars 22 and 24 as well as 23 and 25. The flange 28 which is embedded into the structural member 10 prevents, in the same way as the flange 12 in the case of the element in accordance with FIGS. 1 to 6, the body 21 from being torn, when the shuttering is removed, out of the structural member 10 and away from the nuts 34, 35. This would be undesirable, although naturally the reinforcing parts 22, 23 would remain anchored in the concrete structural member 10 and the reinforcing parts 24, 25 could readily be screwed onto the nuts 34, 35 held by those.

What is advantageously in the case of the modified embodiment is more especially the fact that identical plastics bodies 21 can be used, depending on the necessary strength of the connection, selectively with respectively two, four or six reinforcing parts, in that, depending on choice, nuts are pressed into the central, outer or all of the projections 29, 30, 31.

Figure 10:
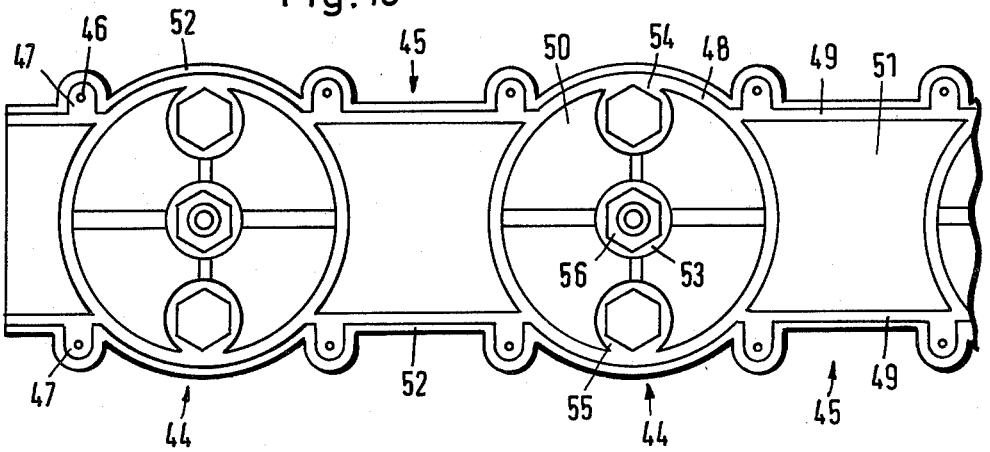
FIG. 10 shows a partial front view, corresponding to FIGS. 3 and 7, of a component part of another modification of the connecting element.

In the case of the further modified embodiment which is shown partially in FIG. 10, several, for example four, dish-shaped bodies 44 are combined, by connecting parts 45 which are U-shaped in cross-section, into a one-piece plastics body, in which respect the ribs 47, provided with through-holes 46 for nails, are formed not on the dish edges 48 but on the limbs 49 of the connecting parts 45. The dish bases 50 of the bodies 44 form, with the webs 51 of the connecting parts 45, a plate which projects above the dish edges 48 and the limbs 49 on both sides to form a respective flange 52. The end surfaces, visible in FIG. 10, of the projections 53, 54, 55 of the bodies 44, the dish edges 48, the ribs 47 and the limbs 49 lie in a plane which extends parallel to the plate formed from the dish bases 50 and the webs 51 and perpendicular to the axes of the projections 53, 54, 55 and of the nuts 56 pressed into the central projections 53.

The one-piece plastics body consisting of the bodies 44 and the connecting parts 45 is used in the same way as the bodies 1 and 21, in that it is nailed onto a shuttering, and reinforcing parts are screwed on its rear side and, after the shuttering has been removed, on its front side into the nuts 56. For particularly strong connections—as in the case of the body 21—a nut can be pressed into each of the projections 53, 54, 55, so that up to six reinforcing bars can be screwed on per body 44.

Connecting elements of the kind shown in FIG. 10 are intended for the connection of reinforced concrete structural members in the case of large-scale workings, where special particularly large shuttering panels are used. The connecting elements shown in FIGS. 1 to 9 are more suitable for connecting the (reinforced) concrete structural members in conventional house building, in which conventional shuttering panels are used. If these particularly large special shuttering panels are used, which are as a rule erected by means of a crane, the connecting elements (the plastics bodies) cannot in all instances be nailed onto the shuttering: If namely such a shuttering panel is erected for a reinforced concrete structural member that is to be cast, after the reinforcement thereof has already been placed, then the connecting elements can no longer be nailed onto the shuttering panel, because the reinforcement makes access impossible. It is true that the connecting elements could be nailed on prior to the erection of the shuttering panel. For this, however, this would have to be erected in a precisely predetermined position; this is because the connecting elements must come to rest precisely at the point at which the two reinforced concrete structural members that are to be cast are to be connected to one another. The connecting element in accordance with FIG. 10 is in these instances used as follows: The front side of the plastics part 44, 45 is closed off by an elongate shaped body (made for example of polystyrene) which is adapted to it. This consists of an elongate plate which butts tightly against the end surfaces of the ribs 47, dish edges 48, limbs 49 and the projections 53, 54 55, and of projections which are formed on the plate and which project into the hollow spaces formed between the dish edges, projections and ribs of the bodies 44 and the limbs of the connecting parts 45, and are clamped fast for example against the body ribs extending in the longitudinal direction. The plastics part 44, 45, covered at the front by the shaped body, is provided on the rear side with the reinforcing parts and then fastened by means of wire and/or with the aid of appropriately designed clamps to the laid reinforcement for the concrete structural member that is to be cast, so that the reinforcing parts situated on the rear side project into the positioned reinforcement, and the shaped body comes to rest directly against the shuttering panel that is to be erected after that. After the concrete structural member has been cast and the shuttering has been removed, the shaped body is taken off from the plastics part, in which respect a possible thin layer of concrete which has passed upon the casting between the shaped body and the shuttering panel readily drops off. Now the reinforcing parts are mounted on the front side of the plastics body and the other concrete structural member that is to be connected is produced.

The connecting element in accordance with the invention is simple and economical to produce and not bulky upon storage and transportation, because the reinforcing parts are, in this respect, still not screwed into the nut. These parts can be kept in store in shapes and sizes which are adapted to the respective conditions. The use of connecting elements in accordance with the invention is simple and time-saving. Reinforcing parts which jut out from the first structural member are not present until they are needed. The achieved strength of the connection is in the case of (non-reinforced) concrete structural members greater than that of the structural members themselves and reaches in the case of reinforced concrete structural members almost the strength of the same.

I claim:

1. A connecting element for concrete and reinforced concrete structural members, that are to be cast one after the other, comprising a hollow body (1;21) having a base portion (2; 26) and a shell portion (3;27), said shell portion (3; 27) having an edge lying in a plane and encircling an opening;

a projection or sleeve (4; 30, 31) securely connected in said hollow body (1;21) and projecting from said base portion (3; 37) towards said plane and including a threaded hole (5; 34, 35) being accessible at both ends;

said hollow body (1; 21) having through-holes (7; 42) adapted to receive nails for releasable fastening the hollow body to a shuttering (8) and tightly butting said edge of the shell portion (3; 27) against the shuttering (8); and two reinforcing parts (9, 11; 22, 24; 23, 25) provided at one end with an external thread of which one (9; 22; 23) is to be screwed, for embedding into the structural member (10) that is to be cast first of all, into one half of said threaded hole (5; 34, 45) and the other of which (11; 24; 25) is to be screwed, after removal of the shuttering (8), into the other half of said threaded hole (5; 34, 35) and is to be embedded into the other structural member that is to be cast thereafter.

2. A connecting element as claimed in claim 1, wherein said base portion (2; 26) has a ridge (12; 28) projecting over said shell portion (3; 27).

3. A connecting element as claimed in claim 1, wherein the axis of said threaded hole (5; 34, 35) is perpendicular to said base portion (2; 26) and said plane.

4. A connecting element as claimed in claim 1, wherein the cross-section of said hollow body is tapered towards the side which is intended to butt against the shuttering.

5. A connecting element as claimed in claim 1, wherein the cross-section of said hollow body encircled by said shell portion (3; 27) is tapered towards the side which is intended to butt against the shuttering.

6. A connecting element as claimed in claim 1, including ribs (6; 32, 33, 36, 37) connected to laterally support said projection or sleeve (4; 30, 31) against said shell portion (3; 27).

7. A connecting element as claimed in claim 1, wherein the free end of said projection or sleeve (4; 30, 31) lies in said plane.

8. A connecting element as claimed in claim 1, wherein the surface of said hollow body at least partially affords a good grip.

9. A connecting element as claimed in claim 1, wherein the hollow body (1; 21) and said projection or sleeve (4; 30, 31) are formed in one piece from plastic material and said threaded hole is formed in a metal part (5; 34, 35) which is seated securely in said projection or sleeve (4; 30, 31).

10. A connecting element as claimed in claim 1, wherein the threads at the end of said reinforcing parts (9, 11, 22, 24; 23, 25) are less than half as long as said threaded hole (5; 34, 35).

11. A connecting element as claimed in claim 1, comprising a plug (43) seated in said other half of said threaded hole (5; 34, 35) and made of compressible material, preferably foam material, which is compressed, upon the screwing-in of the other reinforcing part (24, 25), between the end surface of the threaded bolts of the two reinforcing parts (22, 24; 23, 25).

12. A connecting element for concrete and reinforced concrete structural members, that are to be cast one after the other, comprising a hollow body (44, 45) having an elongate plate (50, 51) with limbs (49) projecting outwardly therefrom along the longitudinal sides thereof and with ribs (48) extending transversely to said limbs (49) and connecting the limb at the one longitudinal side with the limb at the other longitudinal side of said plate (50, 51) and dividing the hollow space between said plate and said limbs in a plurality of cells, the limbs (49) and the and the ribs (48) having edges lying in a plane and encircling an opening for each cell;

a plurality of projections or sleeves (53), each being securely connected in said hollow body (44, 45) and protruding from said plate (50, 51) towards said plane and including a threaded hole (56) being accessible at both ends;

said hollow body (44, 45) having through-holes (46) adapted to receive nails for releasable fastening the hollow body (44, 45) to a shuttering (8) and tightly butting said edges of said limbs (49) and said ribs (48) against the shuttering (8); and two reinforcing parts (22, 24; 23, 25) for each of said threaded holes (56), provided at one end with an external thread, of which one (22; 23) is to be screwed, for embedding into the structural member (10) that is to be cast first of all, into one half of the threaded hole (56) and the other of which (24; 25) is to be screwed, after removal of the shuttering (8) into the other half of the threaded hole (56) and is to be embedded into the other structural member this is to be cast thereafter.

13. A connecting element as claimed in claim 12, wherein said elongate plate (50, 51) has two ridges (52), projecting at the two longitudinal sides over said limbs (49).

14. A connecting element as claimed in claim 12, wherein the axes of said threaded holes (56) are perpendicular to said elongate plate (50, 51) and said plane.

15. A connecting element as claimed in claim 12, wherein each of said projections or sleeves (53) is supported laterally by means of second ribs (32, 33, 36, 37) against the limbs (49) and the first ribs (48).

16. A connecting element as claimed in claim 12, wherein the free end of said projections or sleeves (53) lie in said plane.

17. A connecting element as claimed in claim 12, wherein the surface of said hollow body at least partially affords a good grip.

18. A connecting element as claimed in claim 12, wherein the hollow body (44, 45) and said projections or sleeves (53) are formed in one piece from plastic material and said threaded holes are formed in metal parts (56) which are seated securely in said projections or sleeves (53).

19. A connecting element as claimed in claim 12, wherein the threads at the end of said reinforcing parts (22, 24; 23, 25) are less than half as long as said threaded holes (56).

20. A connecting element as claimed in claim 12, comprising for each of said threaded holes (56) a plug (43) seated in the other half of the threaded hole (56) and made of compressible material, preferably foam material, which is compressed, upon the screwing-in of the other reinforcing part (24, 25), between the end surfaces of the threaded bolts of the two reinforcing parts (22; 24; 23, 25).

* * * * *